United States Patent [19]

Kim

[11] Patent Number: 4,470,320

[45] Date of Patent: Sep. 11, 1984

[54] JOYSTICK ASSEMBLY WITH WEAR MEMBER

[75] Inventor: Syng N. Kim, Hoffman Estates, Ill.

[73] Assignee: Wico Corporation, Niles, Ill.

[21] Appl. No.: 522,630

[22] Filed: Aug. 15, 1983

Related U.S. Application Data

[63] Continuation of Ser. No. 320,174, Nov. 12, 1981, abandoned.

[51] Int. Cl.[3] ..... G05G 9/00; H01H 21/00

[52] U.S. Cl. ..... 74/471 XY; 200/6 A

[58] Field of Search ..... 74/471 XY, 566, 18.1; 180/90.6; 200/6 A

[56] References Cited

U.S. PATENT DOCUMENTS

| | | | |
|---|---|---|---|
| 1,660,278 | 2/1928 | Schwarze, Jr. | 74/566 |
| 2,471,841 | 5/1949 | Sells | 200/6 A |
| 2,724,980 | 11/1955 | Russell | 74/566 |
| 2,896,034 | 7/1956 | Nolden et al. . | |
| 3,666,900 | 5/1972 | Rothweller et al. . | |
| 3,745,966 | 7/1973 | Seager | 74/471 XY |
| 4,181,827 | 1/1980 | Diepeveen . | |
| 4,259,878 | 4/1981 | Anderson . | |

OTHER PUBLICATIONS

Wico Corporation Drawing No. 15-9531-01, Jun. 30, 1981.

*Primary Examiner*—Kenneth Dorner
*Attorney, Agent, or Firm*—Emrich & Dithmar

[57] ABSTRACT

A joystick assembly includes a relatively soft plastic frame and a relatively hard shaft extending through an opening in the frame which is dimensioned to accommodate limited pivotal movement of the shaft. A metal wear member is insert molded in the frame and has an aperture therethrough congruent with the opening in the frame to limit movement of the shaft and prevent wear of the frame around the opening therein. Three different shapes of opening are disclosed for different ranges of pivotal movement.

10 Claims, 6 Drawing Figures

JOYSTICK ASSEMBLY WITH WEAR MEMBER

This is a continuation of application Ser. No. 320,174, filed Nov. 12, 1981, now abandoned.

The present invention relates to a joystick assembly of the type which is used for controlling the operation of certain electronic games and the like. For example, the joystick assembly may be used to control the movement of a "blip" on the cathode ray tube screen of a video game. Such a joystick assembly typically includes a frame for mounting the assembly on the housing of the associated game and for pivotally supporting a control shaft. The shaft extends through an opening in the frame and has a handle for manipulating the shaft through a range of pivotal movement which is determined by the size and shape of the opening. The other end of the shaft is disposed for engagement with the contacts of associated electrical switches, such as microswitches, to control the operation of the game.

The joystick frame is commonly formed of a relatively soft material such as plastic, while the shaft is formed of a relatively hard material such as a hard metal. Accordingly, a problem has arisen in that after a number of hours of operation of the joystick assembly, the handle tends to wear away the frame around the edges of the opening. This changes the shape and size of the opening, thereby altering the range of movement through which the shaft can be moved. Since this range of movement is initially carefully adjusted with respect to the positions of the associated microswitches, any change therein can seriously affect the operation of the joystick assembly and the control of the associated game.

SUMMARY OF THE INVENTION

It is a general object of the present invention to provide an improved joystick assembly which avoids the disadvantages of prior assemblies while affording additional structural operating advantages.

An important object of this invention is the provision of a joystick assembly with improved wear resistance.

In connection with the foregoing object, it is another object of the invention to provide a joystick assembly which effectively prevents enlargement of the shaft opening in the frame.

It is another object of this invention to provide a joystick assembly of the type set forth which is of simple and economical construction.

These and other objects of the invention are attained by providing in a joystick assembly including a relatively hard shaft passing through an opening in a relatively soft frame, the opening being dimensioned to accommodate limited pivotal movement of the shaft, the improvement comprising: a wear member fixedly mounted on the frame and having a hardness at least approximately equal to that of the shaft, the wear member having an aperture therein disposed in registry with the opening in the frame for receiving the shaft therethrough and dimensioned to limit the movement of the shaft, whereby the wear member effectively prevents enlargement of the opening in the frame from wear by the shaft.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the invention.

DESCRIPTION OF THE PREFERRED EMBODIMENTS

Figure 1:
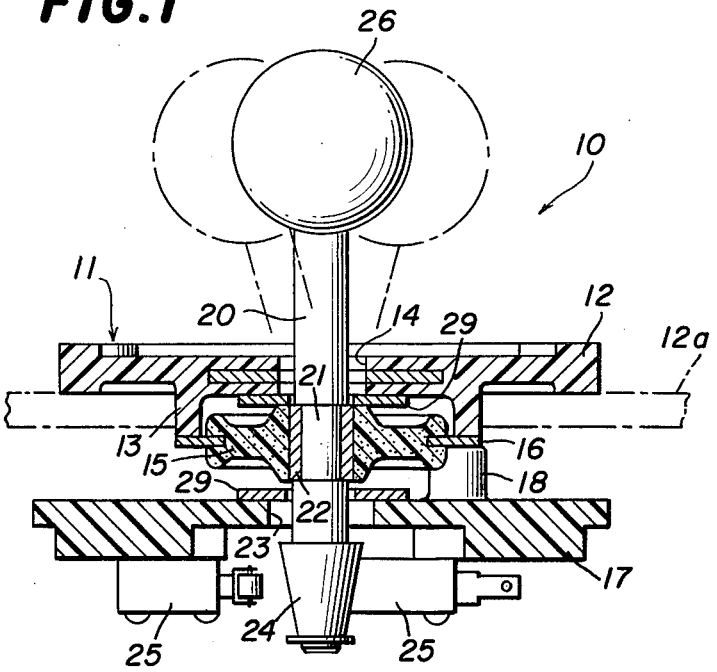
FIG. 1 is a view in vertical cross section of a joystick assembly constructed in accordance with and embodying the features of a first embodiment of the present invention, illustrated in its mounted configuration on an associated device.

Referring now to FIGS. 1 through 4 of the drawings, there is illustrated a joystick assembly generally designated by the numeral 10, constructed in accordance with and embodying the features of a first embodiment of the present invention. The joystick assembly 10 includes a frame 11 which is of unitary one-piece construction and is preferably formed of molded plastic. The frame 11 includes a generally flat rectangular support plate 12 and a cylindrical housing 13 depending from the plate 12 centrally thereof. The frame 11 is adapted to be mounted on a support wall or panel 12*a* of an associated device such as an electronic game, with the support plate 12 overlying the support wall 12*a* and fixedly secured thereto by suitable fasteners (not shown), and with the cylindrical housing 13 projecting through a complementary opening in the support wall 12*a*, as indicated in FIG. 1. The support plate 12 has a circular opening 14 extending therethrough centrally thereof and coaxial with the cylindrical housing 13.

Disposed within the cylindrical housing 13 is a flexible pivot diaphragm 15 secured to an encompassing mounting plate 16 which is disposed in engagement with the inner end of the cylindrical housing 13 around the entire circumference thereof. The joystick assembly 10 also includes a switch mounting plate 17 having a plurality of spaced-apart bushings 18 which engage the inner surface of the mounting plate 16 and receive associated fasteners (not shown) therethrough for securely fastening together the frame 11, the pivot diaphragm 15 and the switch mounting plate 17.

The joystick assembly 10 also includes an elongated cylindrical shaft 20 which extends through the opening 14 in the support plate 12 and has a reduced diameter portion 21 surrounded by a bearing sleeve 22 and fixedly secured in a complementary opening centrally of the flexible pivot diaphragm 15. The inner end of the shaft 20 extends inwardly through a complementary opening 23 in the switch mounting plate 17 and is provided at the tip thereof with an actuator 24 which is disposed for engagement with the contacts of a plurality of microswitches 25 which are carried by the switch mounting plate 17. The outer end of the shaft 20 is provided with a spherical handle 26 to facilitate manipulation of the shaft 20. Washers 29 encircle the shaft 20 above and below the flexible point diaphragm 15.

Figure 4:
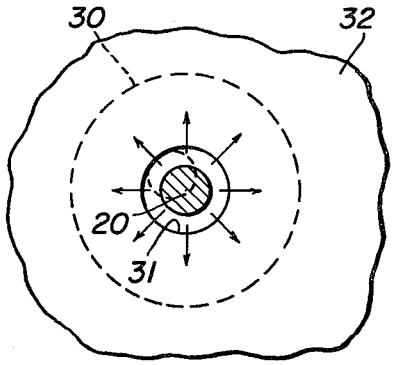
FIG. 4 is a fragmentary top plan view similar to FIG. 2, and illustrating the range of movement of the joystick shaft.

In operation, the flexible pivot diaphragm 15 accommodates a pivotal movement of the shaft 20 about an infinite number of axes passing through the center of the pivot diaphragm 15, a number of these axes being illustrated by the arrows in FIG. 4. However, the extent of movement along any axis is limited by the diameter of the opening 14 in the support plate 12. The opening 14 is dimensioned to permit the shaft 20 to pivot far enough in each direction to bring the actuator 24 into engagement with the contacts of any one of the microswitches 25. Commonly, four such microswitches may be provided at equiangularly spaced-apart locations. Thus, if the shaft 20 is pivoted in any of the horizontal or vertical directions indicated in FIG. 4, only one of the microswitches 25 will be closed, whereas if the shaft 20 is pivoted in one of the diagonal directions indicated in FIG. 4, the actuator 24 will simultaneously close the contacts of two adjacent ones of the microswitches 25. Thus, there is provided an eight-way control. It will be appreciated that the number of possible control variations can be increased by increasing the number of microswitches 25.

The shaft 20 is typically formed of a relatively hard material such as a hard metal, while the frame 11 is formed of a relatively soft material, commonly being molded of a relatively soft plastic. Therefore, prior joystick assemblies of the type described above have experienced significant wear of the support plate 12 around the perimeter of the opening 14. Such wear is highly objectionable because it changes the shape and dimensions of the opening 14, thereby altering the range of movement of the shaft 20 and changing the carefully predetermined positioning of the shaft actuator 24 with respect to the contacts of the microswitches 25.

Accordingly, it is a significant aspect of the present invention that there is provided a wear member in the form of a disc-shaped insert 30. The insert 30 is embedded in the support plate 12, preferably being insert molded therein during the molding of the frame 11. The insert 30 has a circular aperture 31 formed centrally therethrough and dimensioned and arranged to be substantially congruent with the opening 14 in the support plate 12 when the insert 30 is molded in place. The insert 30 is positioned substantially centrally of the thickness of the support plate 12, being sandwiched between outer and inner webs 32 and 33 of the plastic material of the support plate 12. The insert 30 is preferably formed of a metal which is hardened by heat treatment, but it will be appreciated that the insert 30 could be formed of any relatively hard material, as long as the hardness thereof is at least substantially equal to that of the shaft 20.

In use, it will be appreciated that the edge of the insert 30 around the perimeter of the aperture 31 will serve as the limiting surface for limiting movement of the shaft 20. Because of the hardness of the insert 30, it will be substantially resistant to wear from contact with the shaft 20 and will effectively prevent wear of the support plate 12. While, in the preferred embodiment, the aperture 31 in the insert 30 is substantially congruent with the support plate opening 14, the essential criterion is that the aperture 31 be in registry with the opening 14 and that the insert 30 define the movement-limiting surface.

Figure 5:
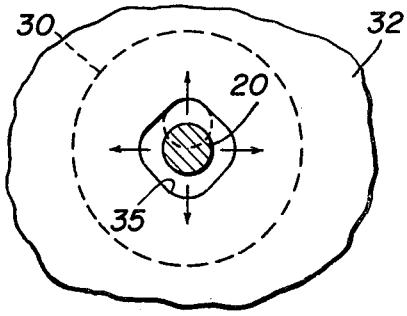
FIG. 5 is a view similar to FIG. 4 and illustrating another embodiment of the present invention.
Figure 2:
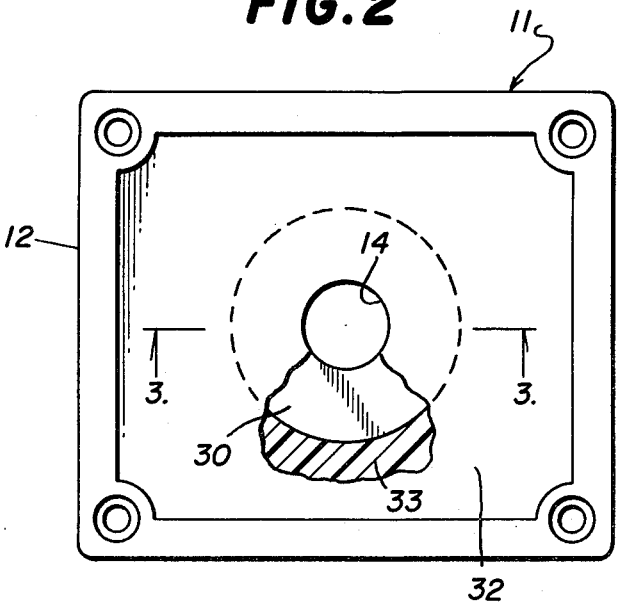
FIG. 2 is a top plan view of the frame of the joystick assembly of FIG. 1.

Referring now also to FIG. 5 of the drawings, there is illustrated an alternative embodiment of the present invention, wherein the support plate opening and the insert aperture designated by the numeral 35, are substantially in the shape of a square having arcuate corners, the radii of the arcs being substantially equal to the radius of the shaft 20. When this shape of aperture is used, the joystick assembly 10 is arranged so that the shaft actuator 24 will close the contacts of the microswitches 25 only when the shaft 20 is pivoted into the corners of the aperture 35 in the direction indicated by the arrows in FIG. 5. Movement to the sides of the aperture 35 between the corners will not be sufficient to actuate the microswitches. This provides a four-way control.

Figure 6:
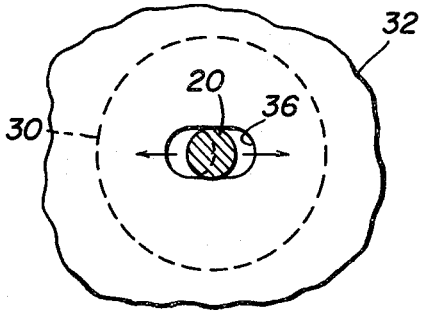
FIG. 6 is a view similar to FIG. 4 and illustrating still another embodiment of the present invention.
Figure 3:
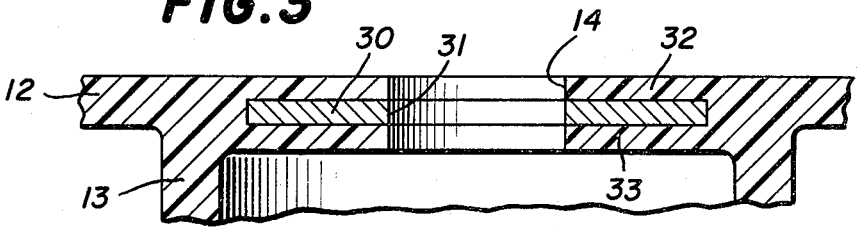
FIG. 3 is an enlarged fragmentary view in vertical section taken along the line 3—3 in FIG. 2.

In FIG. 6 there is illustrated still another embodiment of the present invention wherein the opening in the support plate and the insert aperture, designated 36, are oblong in shape, having parallel sides spaced apart a distance slightly greater than the diameter of the shaft 20 and arcuate ends having radii substantially equal to the radius of the shaft 20. In this arrangement, the shaft 20 is movable in only two directions, indicated by the arrows in FIG. 6, the joystick assembly 10 being arranged so that the shaft actuator 24 will actuate two microswitches 25, respectively when the shaft 20 is disposed in the ends of the aperture 36. This provides a two-way control.

From the foregoing, it can be seen that there has been provided an improved joystick assembly which is resistant to wear around the perimeter of the shaft opening in the frame, this wear resistance being provided in a simple and economical construction.

I claim:

1. In a joystick assembly including a relatively hard shaft passing through an opening in a relatively soft frame of unitary one-piece construction, the shaft having a pivot point on one side of the frame and a handle on the other side of the frame, the opening being dimensioned larger than the thickness of the shaft to accommodate limited pivotal movement of the shaft about the pivot point, the improvement comprising: wear resistant means fixedly embedded in the frame and having a hardness at least approximately equal to that of the shaft, said wear resistant means having an aperture therein disposed in registry with the opening in the frame for receiving the shaft therethrough and dimensioned to limit the movement of the shaft, the entire surface of said wear resistant means except for a surface defining said aperture being enveloped by and in contact with the frame so that only said aperture is exposed, whereby said wear resistant means effectively prevents enlargement of the opening in the frame from wear by the shaft.

2. The joystick assembly of claim 1, wherein said aperture in said wear resistant means is substantially congruent with the opening in the frame.

3. The joystick assembly of claim 1, wherein said frame is formed of plastic, said wear resistant means being insert molded in said frame.

4. The joystick assembly of claim 3, wherein said wear resistant means comprises a member received between webs of plastic frame material, the thickness of said member being at least as great as the thickness of each of said webs.

5. The joystick assembly of claim 1, wherein said wear resistant means is formed of metal.

6. The joystick assembly of claim 5, wherein said wear resistant means is hardened by heat treatment.

7. The joystick assembly in claim 1, wherein said aperture and the opening in the frame are circular in shape.

8. The joystick assembly of claim 1, wherein the joystick shaft is circularly cylindrical in shape, said aperture and the opening in the frame being substantially in the shape of a square with arcuate corners having radii substantially equal to the radius of the shaft.

9. The joystick assembly of claim 1, wherein the shaft is circularly cylindrical in shape, said aperture and the opening in the frame being oblong in shape and having straight parallel sides spaced apart a distance very slightly greater than the diameter of the shaft and arcuate ends having radii substantially equal to the radius of the shaft.

10. In a joystick assembly including a relatively hard shaft passing through an opening in a relatively soft frame of unitary one-piece construction, the shaft having a pivot point on one side of the frame and a handle on the other side of the frame, the opening being dimensioned larger than the thickness of the shaft to accommodate limited pivotal movement of the shaft about the pivot point, the improvement comprising: wear resistant means fixedly embedded in the frame and having a hardness at least approximately equal to that of the shaft, said wear resistant means being substantially flat and received between webs of the frame material, the thickness of said wear resistant means being approximately the same as the thickness of each of said webs, said wear resistant means having an aperture therein disposed in registry with the opening in the frame for receiving the shaft therethrough and dimensioned to limit the movement of the shaft, the entire surface of said wear resistant means except for a surface defining said aperture being enveloped by and in contact with the frame so that only said aperture is exposed, whereby said wear resistant means effectively prevents enlargement of the opening in the frame from wear by the shaft.

* * * * *